US006204741B1

(12) United States Patent
Becker et al.

(10) Patent No.: US 6,204,741 B1
(45) Date of Patent: Mar. 20, 2001

(54) REMOTE-CONTROLLED MECHANISM WITH A MOTOR FOR CIRCUIT-BREAKERS

(75) Inventors: Guntram Becker; Rolf Weinhold; Hagen Trinks, all of Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/546,396

(22) Filed: Apr. 10, 2000

Related U.S. Application Data

(63) Continuation of application No. PCT/DE98/02872, filed on Sep. 28, 1998.

(30) Foreign Application Priority Data

Oct. 8, 1997 (DE) ..... 197 44 457

(51) Int. Cl.[7] ..... H01H 51/00
(52) U.S. Cl. ..... 335/68; 335/14; 335/71
(58) Field of Search ..... 335/14, 68, 69, 335/70–77, 185–191; 200/400

(56) References Cited

U.S. PATENT DOCUMENTS

| | | | | |
|---|---|---|---|---|
| 3,893,050 | * | 7/1975 | Salvati et al. | 335/69 |
| 5,289,773 | | 3/1994 | Saito et al. . | |
| 5,311,161 | | 5/1994 | Calder et al. . | |
| 5,361,699 | | 11/1994 | Compera . | |
| 5,440,989 | | 8/1995 | Becker . | |
| 6,130,392 | * | 10/2000 | Blessitt et al. | 200/400 |

FOREIGN PATENT DOCUMENTS

| | | |
|---|---|---|
| 31 07 223 A1 | 1/1982 | (DE) . |
| 42 14 047 C2 | 4/1994 | (DE) . |
| 43 22 027 A1 | 1/1995 | (DE) . |
| 44 44 629 C1 | 1/1996 | (DE) . |
| 690 24 176 T2 | 7/1996 | (DE) . |
| 0 034 966 | 9/1981 | (EP) . |
| 0 150 756 | 8/1985 | (EP) . |
| 0 427 641 A1 | 5/1991 | (EP) . |
| 0 506 066 A1 | 9/1992 | (EP) . |
| 2 476 906 | 8/1981 | (FR) . |
| 2-204038 | 8/1990 | (JP) . |

* cited by examiner

*Primary Examiner*—Lincoln Donovan
(74) *Attorney, Agent, or Firm*—Herbert L. Lerner; Laurence A. Greenberg; Werner H. Stemer

(57) ABSTRACT

A motor-operated remote-control mechanism for electrical switching devices, especially for circuit breakers, can be used for different sizes with different switching characteristics, while taking necessary safety measures into account. The mechanism consumes as little power as possible and has a simple structure. The circuit breaker is screwed onto a frame. The mechanism can be adapted to several sizes of circuit breakers by using different frames combined with different types of mechanism assemblies with and without a snap-action function.

20 Claims, 8 Drawing Sheets

REMOTE-CONTROLLED MECHANISM WITH A MOTOR FOR CIRCUIT-BREAKERS

CROSS-REFERENCE TO RELATED APPLICATION

This application is a continuation of copending International Application No. PCT/DE98/02872, filed Sep. 28, 1998, which designated the United States.

BACKGROUND OF THE INVENTION

Field of the Invention

The invention relates to a motor-operated mechanism for electrical switching devices, which is intended in particular for circuit-breakers. The coupling of the mechanism to the circuit-breaker is possible through a knob or a latching mechanism.

Coupling to a knob is advisable in order to obtain optimum devices and make them as narrow as possible. In that case, motor-operated mechanisms which bring about snap-action closing of the circuit-breaker are known. Those are described, inter alia, in French Patent Application 2 476 906, European Patent Application 0 034 966 A1, European Patent Application 0 150 756 A2, corresponding to U.S. Pat. No. 4,649,244, and European Patent Application 0 506 066 A1. Those mechanisms are relatively complex. In contrast therewith, there are motor-operated mechanisms having a simpler type of construction for circuit-breakers which themselves have snap-action closing. Such a mechanism is described in German Patent DE 690 24 176 T2. Those are generally unsuitable for circuit-breakers without a snap-action mechanism, since the switching speed is too low. The remote-controlled mechanisms in most cases are screwed onto the circuit-breaker and are constructed specifically for the characteristics of the respective breaker. In order to activate the motor-operated mechanism by a programmable controller, an actuating current should be kept as small as possible. As a result, actuation through the use of an operating magnet or, as in European Patent Application 0 506 066 A1, tripping of a latch through the use of a tripping magnet, appear to be disadvantageous. Manual actuation must be possible at any time.

SUMMARY OF THE INVENTION

It is accordingly an object of the invention to provide a motor-operated remote-control mechanism for electrical switching devices, in particular for circuit-breakers, which overcomes the hereinafore-mentioned disadvantages of the heretofore-known devices of this general type in such a way that it can be used for different sizes with different switching characteristics, taking the required safety measures into account, with minimal power consumption and a simple construction.

With the foregoing and other objects in view there is provided, in accordance with the invention, a motor-operated mechanism with a gearwheel transmission and snap-action closing for electrical switching devices, in particular circuit-breakers, having a twist knob for actuation, comprising a driven gearwheel having a first pin, a second pin and an attachment; a driver reaching through the driven gearwheel for mounting the driven gearwheel centrally through the knob onto the driver, the driver gripping over and establishing a connection with the knob for manual actuation and transferring a driving force; a supporting lever mounted on the driver like the driven gearwheel and leading the driver and the supporting lever to a latching location, at a beginning of a switching-on operation; a prestressed spring received by the driven gearwheel and having a movable end supported on the first pin and simultaneously engaging in the supporting lever, the spring having a prestressing force passing from the first pin to the supporting lever; a resilient driver; a lug; an adjustment-free snap-action system; first and second limit switches; and a geared motor; the driven gearwheel continuing to rotate alone, stressing the spring further, until the second pin releases the latching location, and transfers a switching-on torque of the spring to the driver, the driver switching the circuit-breaker on with snap action, and subsequently the driven gearwheel with the resilient driver being driven resiliently against the knob, until the attachment moves the lug actuating the adjustment-free snap-action system and in turn actuating the first limit switch initiating reversing operation of the geared motor and of the driven gearwheel, for returning the driven gearwheel, the spring and the supporting lever to a starting position until the second limit switch ends the switching-on operation and carries out a switching-off movement in a manner analogous to the switching-on movement without snap action.

A comparison reveals the following:

| Motor-operated mechanism according to the invention | Conventional apparatus |
|---|---|
| 1 limit switch | 1 limit switch, cap<br>1 limit switch, closing<br>1 limit switch, electrical separation when there is mechanical separation |

Other features which are considered as characteristic for the invention are set forth in the appended claims.

Although the invention is illustrated and described herein as embodied in a remote-controlled mechanism with a motor for circuit-breakers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 7:
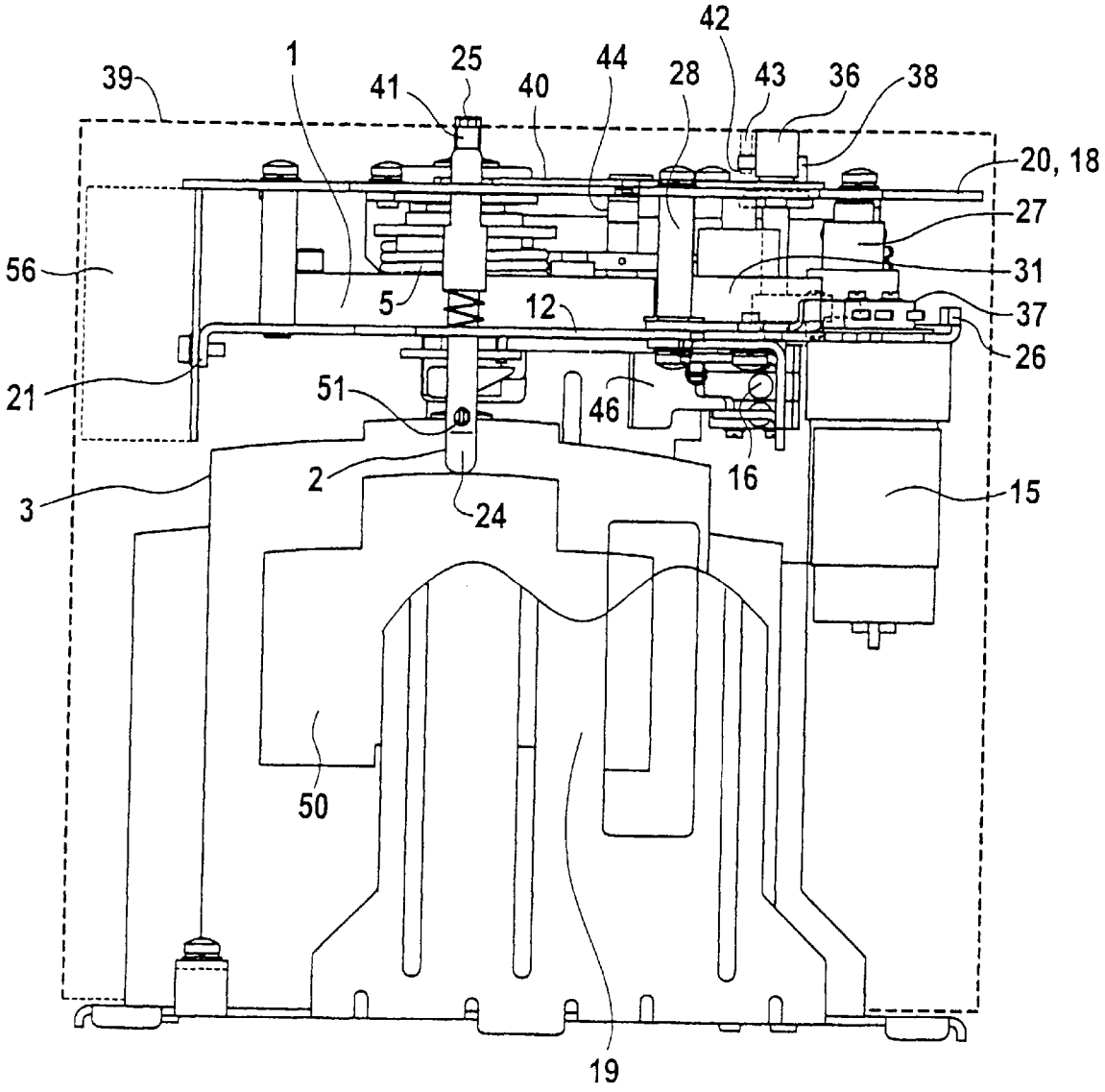
FIG. 7 is a side-elevational view of a mechanism assembly with a frame and a circuit-breaker, in which a complete motor-operated mechanism with a circuit-breaker is represented.

Referring now in detail to the figures of the drawings, in which a functional sequence is described on the basis of representations made therein, and first, particularly, to FIGS. 1–5 thereof, there is seen a geared motor 15 on a pivot lever 26 having a gearwheel 27, which can be pivoted out 20 of gearwheel engagement in the event of a fault for manual actuation with an eccentric 35 (distance a) having a pin 34. The drive gearwheel 27 is mounted with the geared motor 15 on a first spacing bolt 28. Another spring 29 is disposed between the pivoting lever 26 and a second spacing bolt 30 and acts on the pivoting lever 26 with a torque. The geared motor 15 drives a driven gearwheel 1 through a coupling gearwheel 31. The driven gearwheel 1 is seated on a spindle (driver 4) with a circuit-breaker 3 to be switched that is seen in FIG. 7, which shows a complete motor-operated mechanism with the circuit-breaker 3. A resilient stop 48 switches off the circuit-breaker 3. The driver 4, which is part of a mechanism assembly 17 or 18, grips around a knob 2 of the circuit-breaker 3 and has a similar knob 25 with an interlocking mechanism 23 (lockable) for manual actuation and for indicating a switching position. The two actuating knobs 2, 25 are rigidly coupled to one another in a direction of rotation. The actuating knob 2 of the circuit-breaker 3, which has internal snap-action closing, is turned by the driven gearwheel 1 about a loose and resilient coupling into a respectively desired switching direction ON or OFF. Once this circuit-breaker has reached its snap-action closing point, for example in the ON direction, it can switch on unhindered. The motor-operated mechanism continues to travel itself in this direction until a snap-action system 13 of the motor-operated mechanism shown in FIG. 5, that is actuated by attachments 11 on the driven gearwheel 1, changes the rotational direction of the motor at a lug 12. The snap-action system 13 actuates a first limit switch 14. A further spring 45 is drawn after switching of the circuit-breaker 3 beyond dead center of a snap-action lever 46. In this case, drivers 47 shown in FIG. 2 operate resiliently against the driver 4 and consequently against the knob 2. The switching-on or switching-off position is reliably reached. This operation is all the more important in the case of free tripping of the circuit-breaker 3, since reliable relatching requires this operation.

Figure 1:
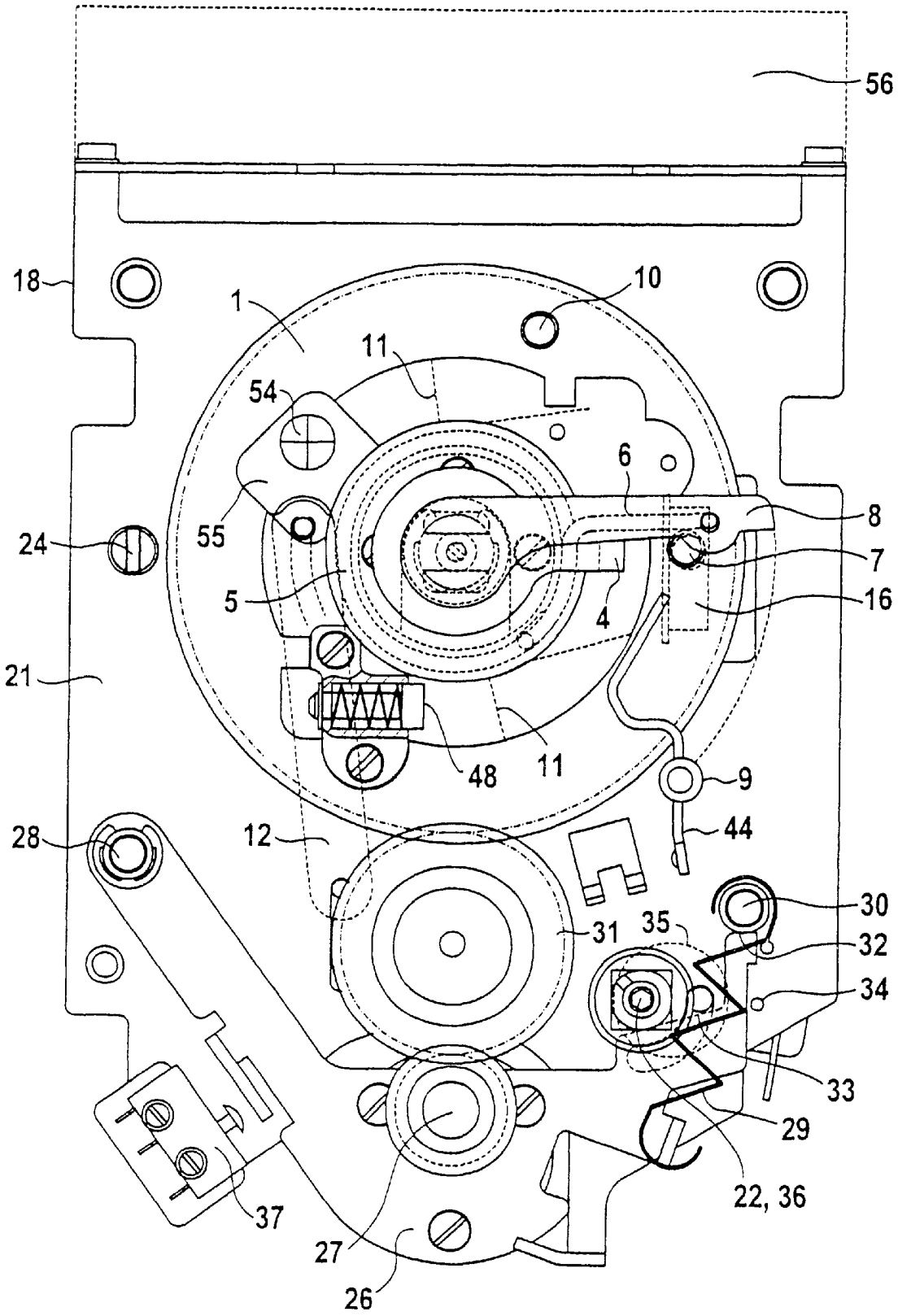
FIG. 1 is a diagrammatic, plan view of a mechanism assembly with snap-action closing, in which an upper mounting plate is removed.
Figure 2:
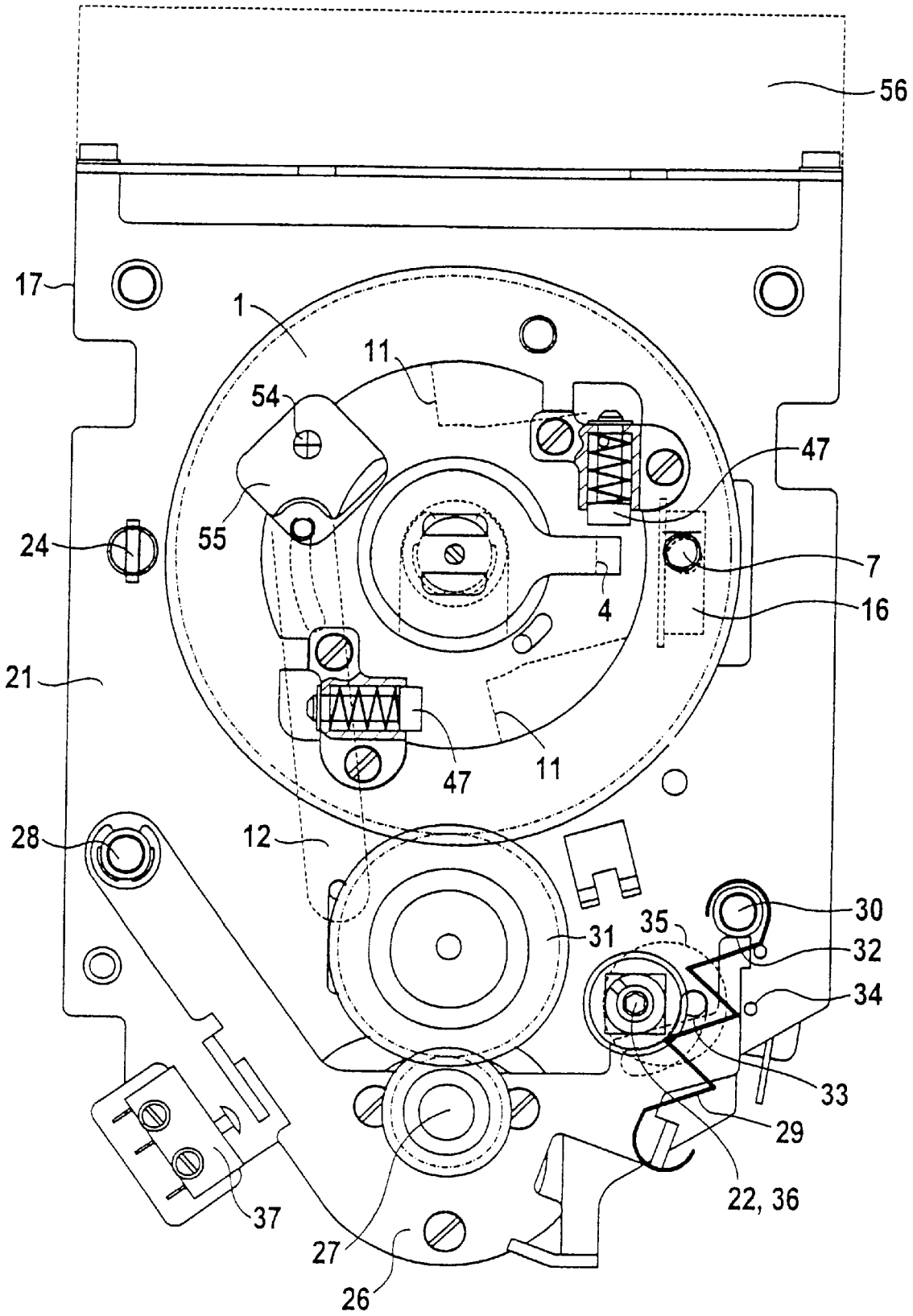
FIG. 2 is a plan view of a mechanism assembly without snap-action closing, in which the upper mounting plate is removed.
Figure 4:
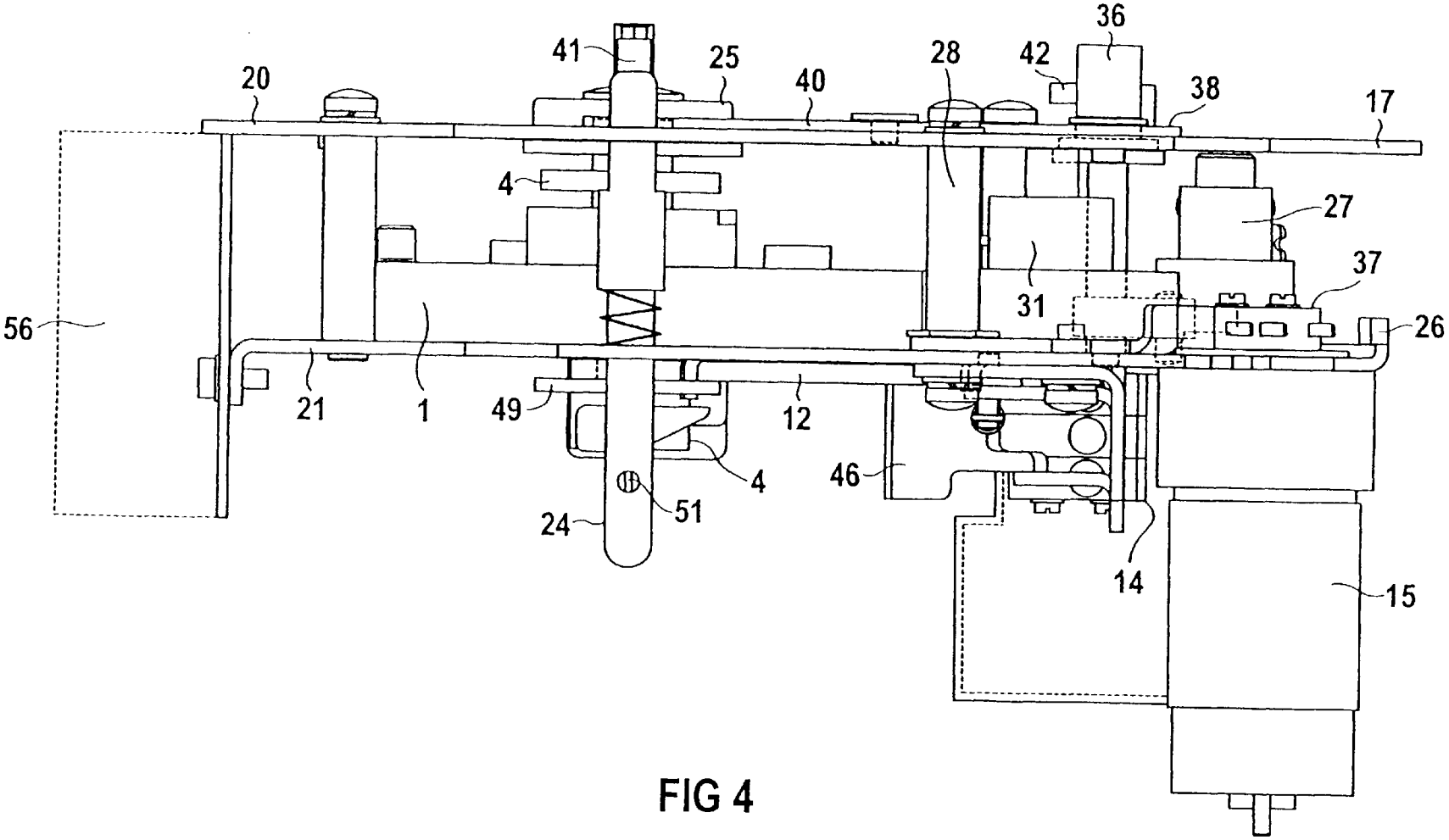
FIG. 4 is a side-elevational view of a mechanism assembly without snap-action closing.
Figure 5:
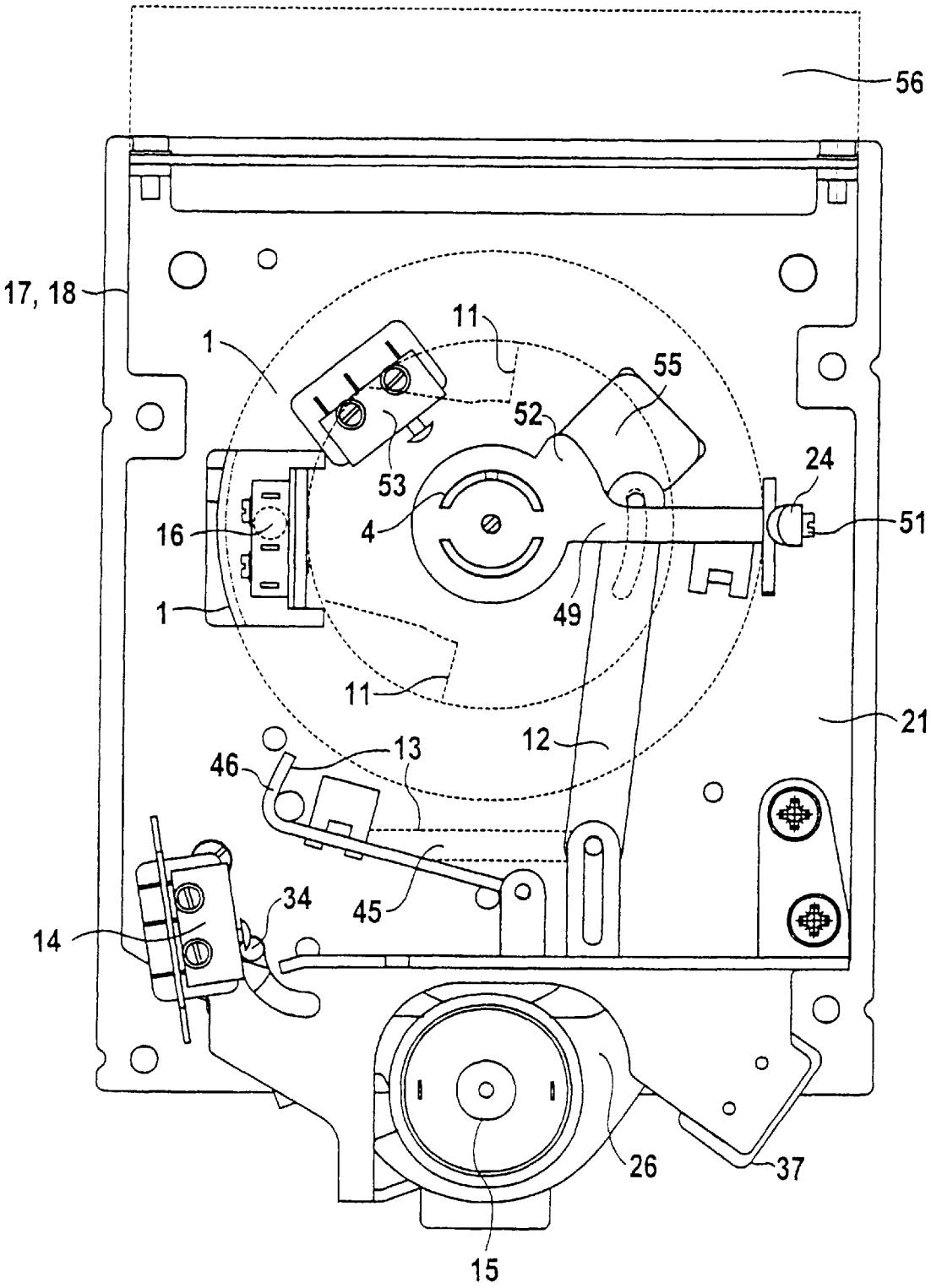
FIG. 5 is a bottom plan view of a mechanism assembly with and without snap-action closing (snap-action system)

The driven gearwheel 1 is returned to a starting position by pole reversal of the motor 15 through limit switches 37 shown in FIGS. 4, 5, 7, so that clearances 55 are again one above the other and a current or power setting 54 of the circuit-breaker 3 shown in FIGS. 1 and 2 is visible and operable, and manual switching is possible. Switching off is performed through the use of a second limit switch 16.

Figure 8:
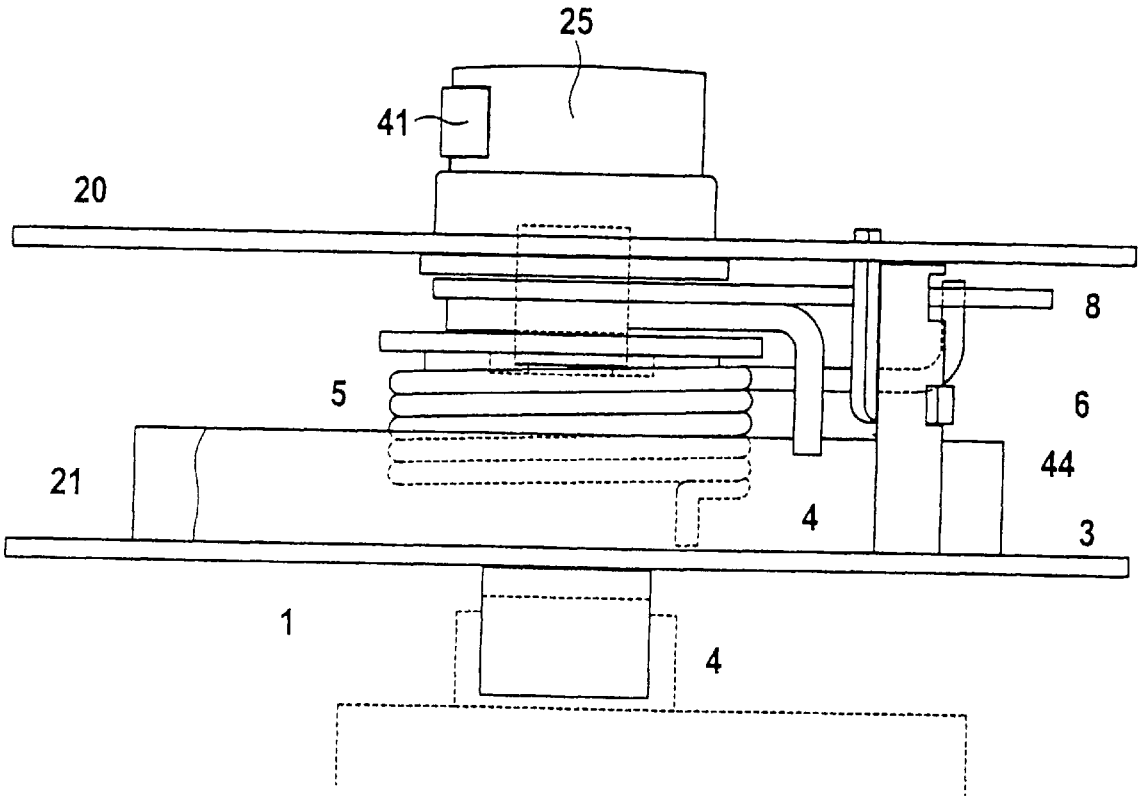
FIG. 8 is a side-elevational view illustrating the principle of snap-action closing (latch system).

The circuit-breaker 3 without snap-action closing (FIGS. 2 and 4) is actuated in a similar way, but the switching on is performed with the aid of a prestressed spring and a latch system shown in FIG. 8. Adaptation to the circuit-breaker 3 without snap-action closing is achieved by simple and slight modification of the system or assembly 17 into the system or assembly 18.

The driven gearwheel 1 has a torsion spring 5, 6 and a supporting lever 8 shown in FIGS. 1 and 8 and is moved up to a latching location 9. At this point, a torque of the torsion spring 5 is transferred by a first pin 7 of the driven gearwheel 1 to the supporting lever 8. The spring is stressed further by the geared motor. As this gearwheel 1 continues to move, a second pin 10 on the driven gearwheel 1 releases the latching. The torque of the spring 5 is then transferred to the driver 4 and consequently the circuit-breaker 3 with snap action is closed.

As the procedure continues, the torsion spring 5 then takes over a resilient overtravel for switching over the snap-action system according to FIGS. 5. After switching over, the system moves back again to the starting position. The following applies for the torsion spring:

$$M_{torsion\ spring} > M_{circuit\text{-}breaker}$$

Consequently, adaptation of the torques through the spring is possible.

In the starting position, to which the driven gearwheel 1 is returned after every execution of a command, the knob 25 of the motor-operated mechanism can at any time be switched over manually. In this case, the motor-operated mechanism is then automatically made to follow and consequently the condition of dominant OFF is satisfied. This is achieved by a limit switch 53, which is actuated by a deformation 52 of a resetting lever 49 and is connected parallel to an ON button. In the event of a fault, i.e. a voltage failure, during a switching operation in the motor-operated mechanism, the geared motor 15 must be pivoted through the use of a tool disposed in a cap 39 for an actuation of a switching-over bolt 36 shown in FIG. 7 into a "manual" position for manual operation. It is only in this position that the cap 39 can be removed and the arresting and locking of the knob can be performed, as described.

The motor-operated mechanism also includes a button 24 with a screw 51 for resetting a pilot switch 50 for short-circuit tripping. In the supplied state, this resetting is performed automatically when switching off takes place or a RESET function is executed after tripping of the circuit-breaker. If the user does not want this, this automatic mechanism can be disabled by removing the screw 51 in the resetting button 24. An electronic control for the sequence is accommodated on a circuit board 56, which is fastened between mounting plates 20, 21. A slide 41 can be pulled out of the knob 2 and engages in the upper mounting plate 20. Through the use of the configuration according to the invention, adaptation to different circuit-breakers 3 with different switching characteristics is achieved with very low power consumption. The snap-action system being used operates without requiring any adjustment.

The circuit-breaker 3 is screwed onto a frame 19 shown in FIG. 7. Individual parts of the mechanism assemblies 17, 18 are mounted between or on the mounting plates 20, 21 and are placed onto the knob 2 of the circuit-breaker 3, screwed to the frame 19 and covered with the cap 39. The remote-controlled mechanism is connected through a plug-in connector to supply voltages and control devices for the actuation. Adaptation to a number of sizes of circuit-breakers is performed by using different frames 19 in combination with different types of mechanism assemblies 17, 18, with and without snap action. The basic construction is the same in this case and different mechanism assemblies are produced by exchanging or omitting just a few parts. FIG. 1 shows a plan view of a mechanism assembly with snap action. The gearwheel coupling 1, 27, 31 with the geared motor 15 can be seen in FIGS. 3 to 5 and 7. A lateral basic construction is represented in FIG. 8. This figure reveals the driver 4, which serves as a bearing spindle of the driven gearwheel 1, the supporting lever 8 and the knob 25 and is mounted between the mounting plates 20, 21.

A latching system is formed by the torsion spring 5, the pin 7 on the driven gearwheel 1 and a half-shaft 44. The torsion spring 5 is mounted in a prestressed manner on the driven gearwheel 1 and supports itself on the pin 7.

Figure 3:
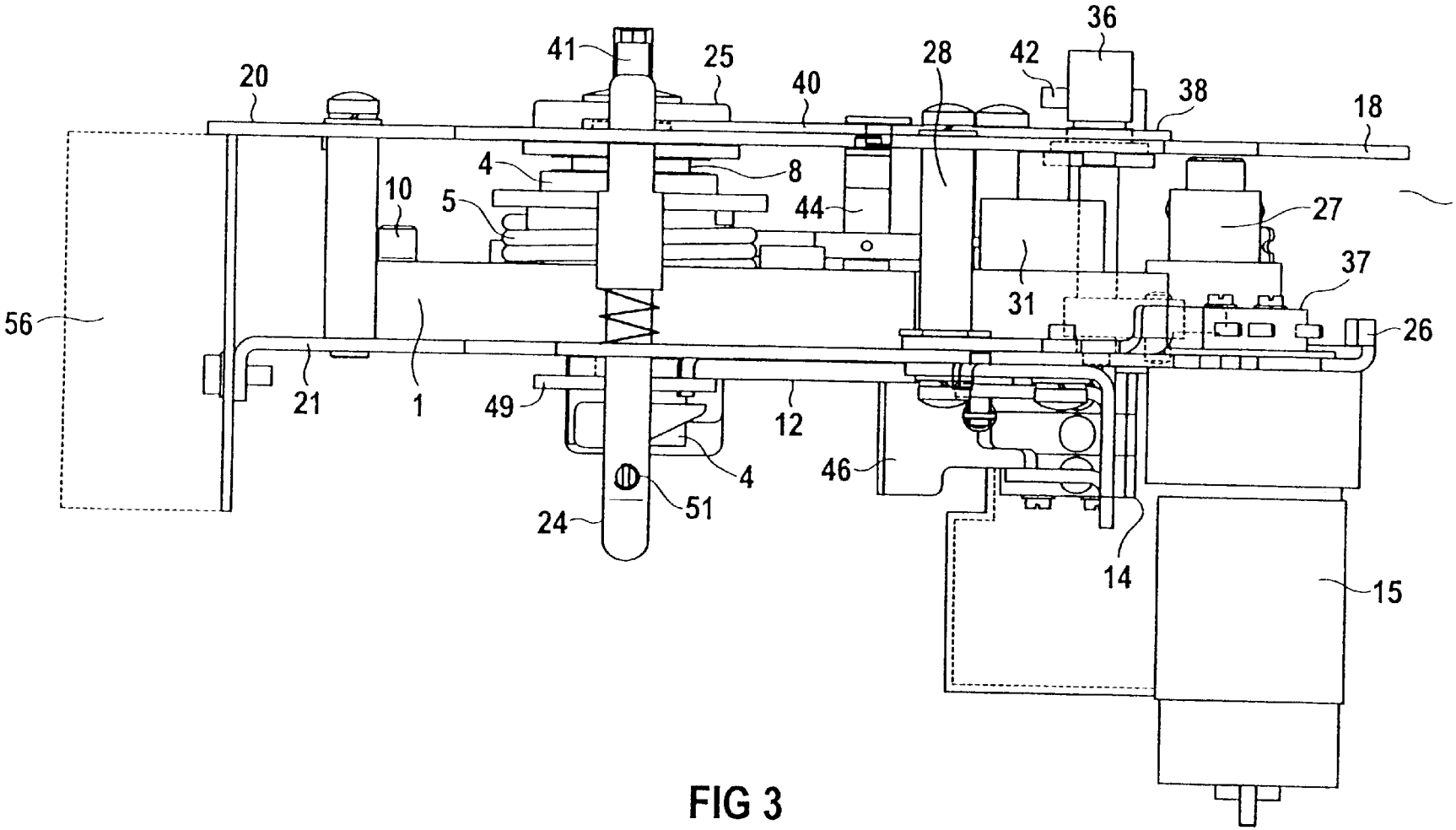
FIG. 3 is a side-elevational view of a mechanism assembly with snap-action closing.
Figure 6:
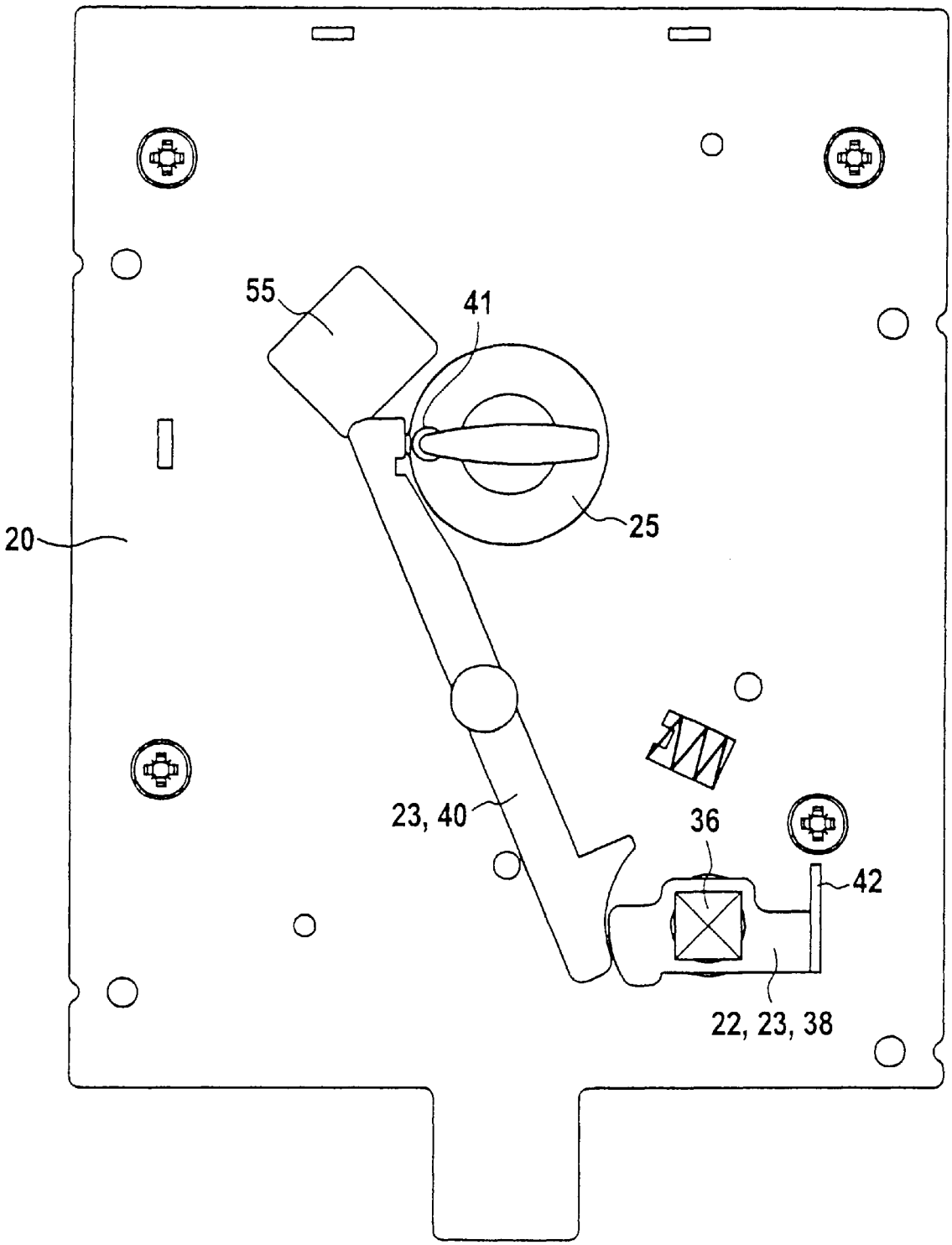
FIG. 6 is a plan view of a mechanism assembly with an upper mounting plate (interlocking system)

FIG. 2 shows a plan view of a mechanism assembly 17 without spring-action or snap-action closing. In comparison with the mechanism assembly 18, the torsion spring 5, the supporting lever 8 and the half-shaft 44 are omitted and the resilient driver 47 is added. The structure of the mechanism assemblies 17 and 18 is represented in FIGS. 3 and 4. The motor-operated mechanism is supplemented by a pivoting system having parts 26, 28, 29, 30, 32, 33 for mechanical decoupling of the gearwheels and electrical separation in manual operation, the snap-action system 12, 13 shown in FIG. 5 for switching over the motor (reversing operation) and the interlocking system 23 of a switching-over device 22 shown in FIG. 6. In this case, the pivoting system and the interlocking system 23 are coupled to one another, in that locking of the knob 25 is possible only in the OFF position of the circuit-breaker 3 when there is mechanical and electrical separation of the motor-operated mechanism.

At the same time, the cap 39 has a hook 43 shown in FIG. 7 for connecting it to a locking bar 38 having an attachment 42. Removal of the cap is possible only when there is mechanical and electrical separation of the device. This combination dispenses with limit switches.

The mechanism 18 with snap-action closing can be produced from the mechanism 17 without snap-action closing by a combination of the drive gearwheel 1 in connection with the supporting lever 8, the half-shaft 44 shown in see FIG. 8 and the spring 5.

We claim:

1. In a motor-operated mechanism with a gearwheel transmission and snap-action closing for a circuit-breaker having a twist knob for actuation, the improvement comprising:

a driven gearwheel having a first pin, a second pin and an attachment;

a driver reaching through said driven gearwheel for mounting said driven gearwheel centrally through the knob onto said driver, said driver gripping over and establishing a connection with the knob for manual actuation and transferring a driving force;

a supporting lever mounted on said driver like said driven gearwheel and leading said driver and said supporting lever to a latching location, at a beginning of a switching-on operation;

a prestressed spring received by said driven gearwheel and having a movable end supported on said first pin and simultaneously engaging in said supporting lever, said spring having a prestressing force passing from said first pin to said supporting lever;

a resilient driver;

a lug;

an adjustment-free snap-action system;

first and second limit switches; and a geared motor;

said driven gearwheel continuing to rotate alone, stressing said spring further, until said second pin releases said latching location, and transfers a switching-on torque of said spring to said driver, said driver switching the circuit-breaker on with snap action, and subsequently said driven gearwheel with said resilient driver being driven resiliently against the knob, until said attachment moves said lug actuating said adjustment-free snap-action system and in turn actuating said first limit switch initiating reversing operation of said geared motor and of said driven gearwheel, for returning said driven gearwheel, said spring and said supporting lever to a starting position until said second limit switch ends said switching-on operation and carries out a switching-off movement in a manner analogous to said switching-on movement without snap action.

2. The motor-operated mechanism according to claim 1, wherein the mechanism is to be entirely converted by slight modification of parts to a mechanism without snap-action closing while retaining a functional sequence.

3. The motor-operated mechanism according to claim 1, including a frame serving as a flat screwing-on surface for the circuit-breaker, and a mechanism assembly removably screwed onto said frame.

4. The motor-operated mechanism according to claim 3, including two mounting plates, and functional parts mounted between said mounting plates, said functional parts having a switching-over device from manual to automatic operation with an interlocking system and said adjustment-free snap-action system for reversing operation of said geared motor.

5. The motor-operated mechanism according to claim 4, including a pilot module guided parallel to said driver between said mounting plates and held in said starting position by said spring, said mechanism assembly having a button for resetting said pilot module.

6. The motor-operated mechanism according to claim 5, including a remote-controlled mechanism knob, said switching-over device for mechanical and electrical separation being combined with said interlocking system for locking said remote-controlled mechanism knob.

7. The motor-operated mechanism according to claim 6, including first and second oppositely disposed spacing bolts, a pivoting lever and a drive gearwheel mounted with said geared motor on said first spacing bolt, and another spring disposed between said pivoting lever and said second spacing bolt and acting on said pivoting lever with a torque, said pivoting lever supported opposite a bearing point on said second spacing bolt.

8. The motor-operated mechanism according to claim 7, including a pivoting system with an edge counterforce, a drive gearwheel and a coupling gearwheel, said resilient pivoting lever configured in a basic position with a support taking on an entire force of said other spring and creating a distance between said drive gearwheel and said coupling gearwheel in a pure form lock, and said driven gearwheel having an edge counterforce less than that of said pivoting system.

9. The motor-operated mechanism according to claim 8, wherein said second spacing bolt simultaneously acts as a spring suspension of said other spring and as a supporting location of said pivoting lever.

10. The motor-operated mechanism according to claim 9, including a limit switch, a switching-over bolt, and an eccentric fixedly connected to said switching-over bolt and having a pin, said pivoting lever having a blade and having a bevel in the vicinity of said supporting location, said pin of said eccentric performing a mechanical separation when said switching-over bolt turns and performing an electrical separation with said blade actuating said limit switch, and said pivoting lever kept by said other spring in a switching-over position and returned again automatically to said starting position upon actuation.

11. The motor-operated mechanism according to claim 10, wherein said mounting plates are upper and lower mounting plates, and including a slide to be pulled out of the knob, a cap, a blocking lever mounted on said upper mounting plate, and a locking bar mounted on said switching-over bolt above said other spring for preventing removal of said cap in automatic operation, for preventing said slide from being pulled out of the knob in an automatic position and for allowing said slide to be pulled out of the knob in a manual position, in connection with said blocking lever.

12. The motor-operated mechanism according to claim 11, wherein said cap has a hook, and said locking bar has an attachment for engaging in and releasing said hook.

13. The motor-operated mechanism according to claim 12, wherein said slide engages in said upper mounting plate and a lock permits locking of said remote-controlled mechanism knob by pulling out said slide in said manual position, but said blocking lever prevents said locking bar on said switching-over bolt from being brought into said automatic position for consequently maintaining said electrical separation.

14. The motor-operated mechanism according to claim 4, including a snap-action lever having a dead center, and a further spring disposed oppositely on said lug relative to a driving action between said lug and said snap-action lever, said adjustment-free snap-action system actuated after said switching-on or switching-off operation for initiating a reversing operation, said attachment in said driven gearwheel actuating said lug, and said further spring being drawn after said switching of the circuit-breaker beyond said dead center of said snap-action lever and actuating said first limit switch.

15. The motor-operated mechanism according to claim 14, wherein said resilient driver associated with said driven gearwheel actuates said driver and allows said driven gearwheel to continue running after said switching-on or switching-off operation, for actuating said snap-action system to reverse operation of said geared motor.

16. The motor-operated mechanism according to claim 15, including a resilient stop for switching off the circuit-breaker, said mechanism assembly having snap-action closing, and said spring being a torsion spring assuming a function of said resilient driver during said switching-on operation.

17. The motor-operated mechanism according to claim 6, including a resetting lever mounted on said driver for resetting said short-circuit pilot module in connection with said button, said button having a screw, forming a point of application of said resetting lever, to be removed for allowing only manual resetting.

18. The motor-operated mechanism according to claim 1, including an ON button, a limit switch parallel to said ON button, and a resetting lever having a deformation actuating said limit switch for allowing trouble-free electrical actuation upon manual actuation.

19. The motor-operated mechanism according to claim 4, wherein said mounting plates and said driven gearwheel have a clearance through which a power setting on the circuit-breaker is accessible in every switching position.

20. The motor-operated mechanism according to claim 3, including a circuit board fastened with a control on said mechanism assembly.

* * * * *